US007824350B2

(12) United States Patent
Lu

(10) Patent No.: US 7,824,350 B2
(45) Date of Patent: Nov. 2, 2010

(54) TOWEL STRUCTURE WITH PROJECTED ENERGY BODY

(75) Inventor: Shin-Chiang Lu, San-Chong (TW)

(73) Assignee: SCI-Sportek Sport Technology Co., Ltd., Taipei (TW)

( * ) Notice: Subject to any disclaimer, the term of this patent is extended or adjusted under 35 U.S.C. 154(b) by 910 days.

(21) Appl. No.: 11/676,749

(22) Filed: Feb. 20, 2007

(65) Prior Publication Data

US 2008/0200846 A1 Aug. 21, 2008

(51) Int. Cl.
*A61H 1/00* (2006.01)

(52) U.S. Cl. ..... 601/136; 601/137

(58) Field of Classification Search ..... 601/136, 601/137, 138; 15/222, 210.1, 208, 209.1
See application file for complete search history.

(56) References Cited

U.S. PATENT DOCUMENTS

| | | | | |
|---|---|---|---|---|
| 6,849,055 | B1 * | 2/2005 | Williams | 601/137 |
| 2005/0197602 | A1 * | 9/2005 | Kwen | 601/131 |
| 2006/0010630 | A1 * | 1/2006 | Tse | 601/137 |

* cited by examiner

*Primary Examiner*—Quang D Thanh
(74) *Attorney, Agent, or Firm*—Banger Shia

(57) ABSTRACT

A towel structure is configured with a plurality of energy bodies mounted on the surface of the towel to form a geometrical pattern with creation and artistry. Due to the energy bodies project from the surface, the energy bodies rub against the skin of the user when using to improve the blood circulation. Additional, the energy bodies mix with energy elements to promote the health of the user.

4 Claims, 3 Drawing Sheets

TOWEL STRUCTURE WITH PROJECTED ENERGY BODY

BACKGROUND OF THE INVENTION

1. Field of Invention

The present invention relates to a towel, and more particularly to a towel structure combined with energy body on the surface of the towel.

2. Related Art

Strength and coordination exercises are becoming increasingly more popular these days. Within health-conscious cultures, sports such as jogging, swimming and bicycling have long been common forms of exercise. More recently, however, those desiring to stay in shape are seeking different, more innovative ways to achieve or maintain a desired level of physical conditioning and mental health, while at the same time trying to decrease the incidence of injuries due to high impact exercising.

Increasingly, health-conscious consumers have been wearing various types of health ornaments in recent years, and the market is inundated with products claiming to promote health or cure various maladies. These health products cover many categories, including clothing such as underwear, ornaments such as bracelets and rings, linens, footwear, step-on-type foot massagers, foods and beverages, and various exercise goods, which are commonly used in daily life and for which the demand is expected to grow.

Hence, there are more exercising or articles for daily use are combined with health-concept. Take the towel for example, for preventing to affect structure and soft, the fibers contain energy powders, such as titanium, germanium, bamboo charcoal, bio ceramics and tourmaline, before knitting. However, such manufacturing is too complicate and expensive.

SUMMARY OF THE INVENTION

To solve the technical problems existing in the prior art, the present invention provides a towel structure with projected energy bodies. The towel is easy to manufacture and with creation and artistry.

Accordingly, the present invention is directed to a towel that includes at least one energy body mounted on a surface of the towel and forming a geometrical pattern on the surface, the energy body made of innocuous material mixing with energy elements and projecting from the surface of the towel. Due to the high ropiness of the innocuous material, the energy elements are easy to secure on the surface of the towel. Also, due to the energy bodies project from the surface, the energy bodies rub against the skin of the user when using to improve the blood circulation. Additional, the energy bodies mix with energy elements to promote the health of the user.

It is to be understood that both the foregoing general description and the following detailed description are exemplary, and are intended to provide further explanation of the invention as claimed.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
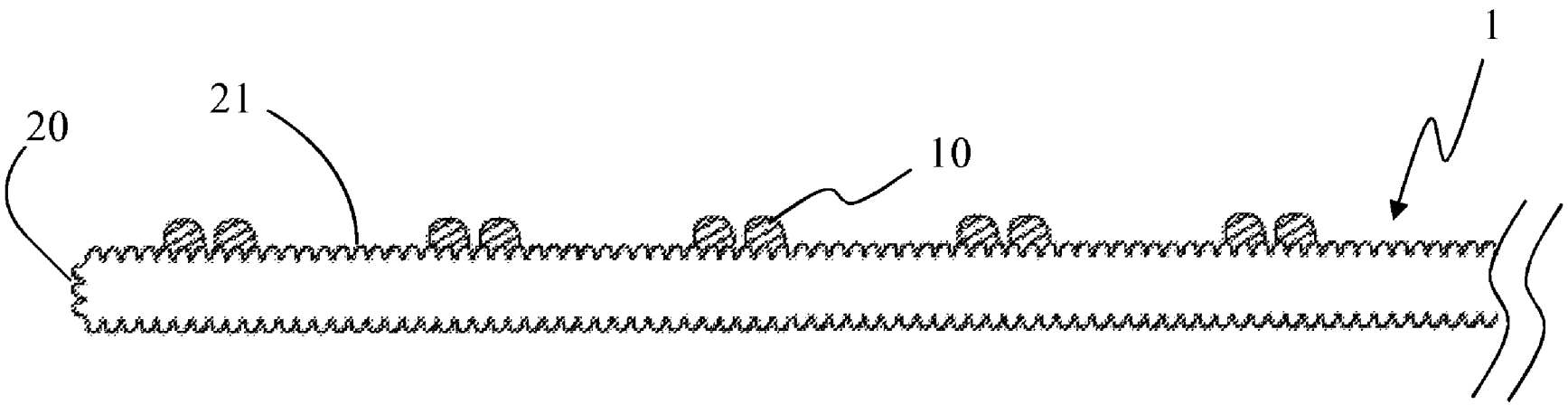
FIG. 1 is a perspective view of a towel structure in accordance with first embodiment of the present invention.

The present invention is related to a towel. Please refer to FIG. 1, a perspective diagram of the towel structure according to first embodiment of the present invention.

The towel 1 includes a towel body 20 and at least one energy body 10. The top surface 21 of the towel body 20 is mounted of the energy body 10. The energy body 10 is made of soft innocuous material, such as PVC and silicone, and mixes with energy element powders, such as titanium, germanium, bamboo charcoal, bio ceramics and tourmaline. Also, the titanium would adopt titanium oxide, titanium carbide or titanium nitride. On the other hand, the energy elements can be replaced with copper, tin, iron and aluminum and their alloy.

Due to the soft innocuous material, such as PVC and silicone, is with high ropiness, after mixing with energy elements, the energy element powders are easy to secure on the top surface 21 of the towel body 20 and form the slightly projected energy bodies 10. Please see FIG. 1, the energy bodies 10 are scatter distribution on the surface of the towel 1.

Figure 2:
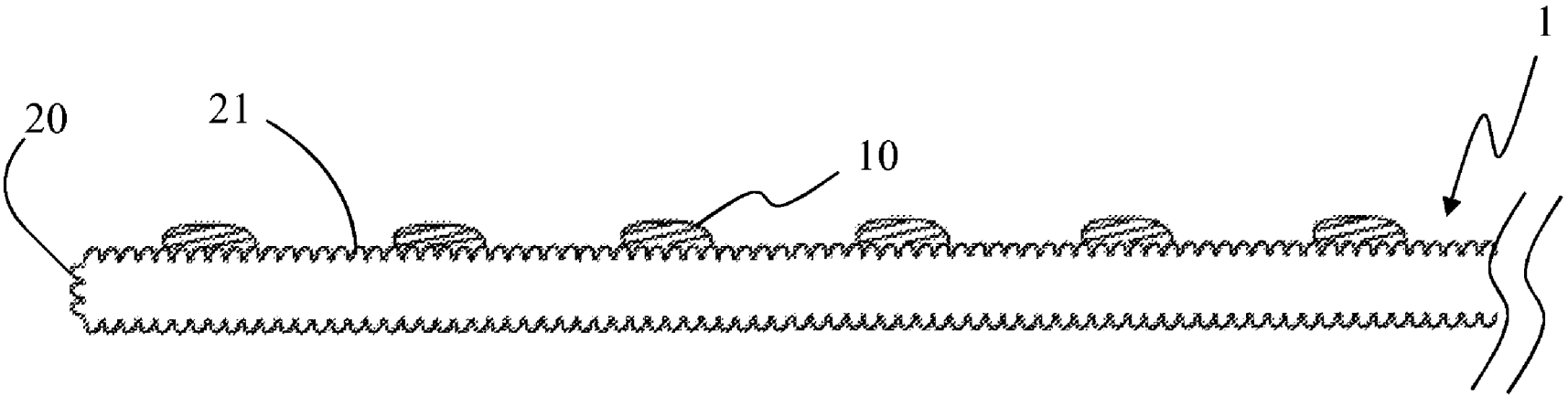
FIG. 2 is a perspective view of a towel structure in accordance with second embodiment of the present invention.
Figure 3:
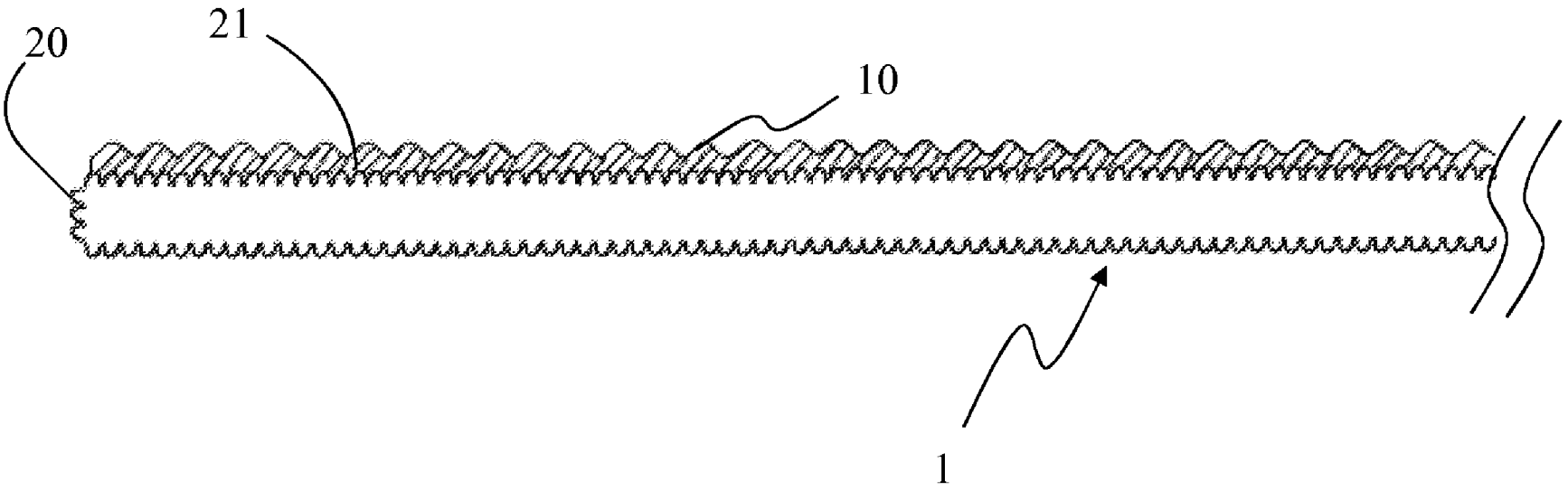
FIG. 3 is a perspective view of a towel structure in accordance with third embodiment of the present invention.

Please refer to FIG. 2, a perspective diagram of the towel structure according to second embodiment of the present invention. The energy bodies 10 are linear or block distribution on the top surface 21 of the towel body 20. Both the linear and block distribution have similar sectional view as shown in FIG. 2. Also, please refer to FIG. 3, a perspective diagram of the towel structure according to third embodiment of the present invention. The energy bodies 10 would cover all the top surface 21 of the towel body 20.

The bio-activation effect and electromagnetic action of energy elements are known to promote blood circulation, metabolism and provide other health benefits. By the present invention, the energy elements are easy and firm to secure on the top surface 21 of the towel body 20. Also, the energy bodies 10 would design various patterns to promote artistry of its appearance. Due to the energy bodies project from the surface, the energy bodies rub against the skin of the user when using to improve the blood circulation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A towel structure, comprising:

a towel body; and at least one energy body mounted on a top surface of the towel body and forming a geometrical pattern on the top surface, said energy body made of soft innocuous material mixing with at least one energy element powder and projecting slightly from the surface of the towel body;

wherein the soft innocuous material is selected from the group consisting of PVC and silicone;

wherein the energy element powder is selected from the group consisting of titanium, germanium, bamboo charcoal, bio ceramics and tourmaline.

2. The towel structure of claim 1, wherein the energy body is scatter distribution on the top surface of the towel.

3. The towel structure of claim 1, wherein the energy body is linear distribution on the top surface of the towel.

4. The towel structure of claim 1, wherein the energy body is block distribution on the top surface of the towel.

* * * * *